US011391102B2

(12) United States Patent
Morret et al.

(10) Patent No.: US 11,391,102 B2
(45) Date of Patent: Jul. 19, 2022

(54) WELL PIPE REMOVAL AND STORAGE DEVICE, SYSTEM AND METHOD

(71) Applicants: Steven Morret, Dillsburg, PA (US); Steven Morret, Jr., Dillsburg, PA (US)

(72) Inventors: Steven Morret, Dillsburg, PA (US); Steven Morret, Jr., Dillsburg, PA (US)

( * ) Notice: Subject to any disclaimer, the term of this patent is extended or adjusted under 35 U.S.C. 154(b) by 120 days.

(21) Appl. No.: 16/931,187

(22) Filed: Jul. 16, 2020

(65) Prior Publication Data

US 2021/0017821 A1 Jan. 21, 2021

Related U.S. Application Data

(60) Provisional application No. 62/875,125, filed on Jul. 17, 2019.

(51) Int. Cl.

| | |
|---|---|
| ***E21B 19/22*** | (2006.01) |
| *E21B 19/00* | (2006.01) |
| *E21B 43/12* | (2006.01) |
| *E21B 17/20* | (2006.01) |

(52) U.S. Cl.

CPC ..... *E21B 19/22* (2013.01); *E21B 17/206* (2013.01); *E21B 19/008* (2013.01); *E21B 43/128* (2013.01)

(58) Field of Classification Search

CPC ..... E21B 19/22; E21B 19/008; E21B 17/206; E21B 31/18

See application file for complete search history.

(56) References Cited

U.S. PATENT DOCUMENTS

| | | | | | |
|---|---|---|---|---|---|
| 3,100,530 | A * | 8/1963 | Coleman | E21B 33/02 | 166/53 |
| 5,180,014 | A * | 1/1993 | Cox | E21B 19/22 | 166/384 |
| 5,653,293 | A * | 8/1997 | Ellis | H02G 1/06 | 172/438 |
| 5,848,641 | A * | 12/1998 | Epp | E21B 19/22 | 166/77.2 |
| 7,810,574 | B2 * | 10/2010 | Stukey | E21B 43/128 | 166/384 |
| 8,671,626 | B1 * | 3/2014 | Marty | E21B 15/00 | 414/22.55 |
| 2015/0292282 | A1 * | 10/2015 | Dyck | B65H 75/4442 | 166/385 |

* cited by examiner

*Primary Examiner* — D. Andrews
(74) *Attorney, Agent, or Firm* — William Gray Mitchell

(57) ABSTRACT

A device, system and method of use for removing well pipe and a subterranean well pump and storing such removed pipe on a spool.

12 Claims, 9 Drawing Sheets

WELL PIPE REMOVAL AND STORAGE DEVICE, SYSTEM AND METHOD

CROSS REFERENCE TO RELATED APPLICATIONS

This application claims priority to U.S. provisional patent application 62/875,125, filed on Jul. 19, 2019.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention is a device and system for removing a well pipe and storing it on a spool, and a related method of removal.

Background of the Invention

For many, wells provide a source of potable water. Wells for drinking or agricultural water typically include a length of pipe that is suspended at one end adjacent to the well cap at the surface, with the opposite end of the water pipe being connected to a pump that is submerged under the level of ground water in a lower portion of a well casing. To allow for maintenance, repair and replacement of a subterranean well pump, the pipe must be pulled from within the well to the surface. Such an operation requires that the water pipe connecting the pump and the well cap be pulled upward, thereby raising the pump to the top. Although it is possible to manually pull the pipe, the use of pulling machines or "pullers" simplify the task.

At present, all known pullers require that, once a pipe is pulled to the surface, the pipe must be laid or pulled away from the well as it is removed to allow access for removal of the pump. This is typically done by one or more persons pulling the pipe away from the well in a generally radial direction to ease the task of re-installing the pipe. In practice, the pipe is dragged across the available ground, whatever the quality of the surface, and extended to its full length. Since well pipes can be 50 to 600 feet in length, with an average of approximately 300 feet, full extension creates significant challenges whenever there is insufficient room to fully extend the pipes, such as wells located in developed residential or commercial areas or wooded areas.

Moreover, dragging the well pipe across the ground can result in either damage to the pipe or in contamination of the pipe with mud, grass and mulch, as well as other undesirable or dangerous materials such as pesticides, herbicides, animal feces, mold, etc., which can then enter the drawn water supply. Further, clinging dirt, turf or similar substances can result in clogging the well pumps after re-installation of the well pipes, requiring two or more pulling operations. The ground and/or landscaping may also be disturbed or damaged by the extended pipe.

One type of known device for avoiding the requirement to lay out pipe on the ground is a pipe hoist, which typically operates as a telescoping crane, is usually truck-mounted and used only for hard pipe installations. Such a hoist device is driven to the well head, where the hoisting crane is deployed upward and the crane line connected to the pipe, allowing the pipe to be pulled directly upwards. These machines are not used on coil pipe settings. Hoists have known limitations, however, primarily in that the height of a mobile crane is necessarily quite limited and thus can only service wells in open spaces. The use of a crane is also impossible in many settings, such as areas with overhanging structures or foliage.

Another commonly used pulling machine is the "upsy daisy" style puller, which requires two or more people both to carry the machine to the well head and then to operate the machine. The machines tend to be electric, requiring long cordage or a generator, and utilize "pull wheels" in the form of rubber tires. Again, the device causes the pipe to be run out lengthwise over surrounding ground.

What is needed is a device and system allowing a well pipe to be pulled and stored in a confined space while the attached well pump is serviced or replaced, thus eliminating the need for an elongated surrounding area for laying out the pipe.

BRIEF SUMMARY OF THE INVENTION

In a preferred embodiment, a well pipe pulling and storage device, comprising a pipe spool, at least one wire spool, a power supply, a pipe spool drive motor, a wire spool drive motor, a brake for the pipe spool, a control table comprising controls for the speed and direction of each pipe and wire spool, a foldable crane and a frame mount comprising a transportation plate for loading onto a vehicle, such vehicle also comprising a power-take-off for providing power to the well pipe pulling and storage device.

In another preferred embodiment, the well pipe pulling and storage device as disclosed herein, wherein the power supply is hydraulic and the controls are one or more valves.

In another preferred embodiment, the well pipe pulling and storage device as disclosed herein, wherein the pipe spool drive motor is powered in both a coiling direction and a payout direction while the wire spool drive motor is powered only in a coiling direction.

In another preferred embodiment, the well pipe pulling and storage device as disclosed herein, further comprising a spring control valve which must be manually engaged to provide power to the pipe spool drive motor and wire spool drive motor and a wire spool detent valve for engaging and disengaging only the wire spool drive motor.

In another preferred embodiment, the well pipe pulling and storage device as disclosed herein, further comprising a pipe spool up control, which governs speed up the pipe spool in a coiling direction, and a pipe spool down control, which governs speed of the pipe spool in an uncoiling direction.

In another preferred embodiment, the well pipe pulling and storage device as disclosed herein, wherein the vehicle is a skid steer or mini skid steer.

In another preferred embodiment, a well pipe pulling and storage system, comprising a pipe spool, at least one wire spool, a pipe spool motor, a wire spool motor, a control table comprising controls for the speed and direction of each pipe and wire spool, a foldable crane, a frame mount comprising a transportation plate for loading onto a vehicle, such vehicle comprising a power-take-off for providing hydraulic power to the well pipe pulling and storage device, wherein the hydraulic power system comprises hydraulic piping, a pipe spool drive motor, a wire spool drive motor, a hydraulic brake for each of the pipe spool and wire spool, a pressure gauge, a spring control valve, a wire spool detent valve, flow control balance valve and adjustable relief valve.

In another preferred embodiment, the well pipe pulling and storage system as disclosed herein, wherein the pipe spool drive motor is a hydraulic gear reduction motor and the wire spool drive motor is a hydraulic motor.

In another preferred embodiment, the well pipe pulling and storage system as disclosed herein, further comprising a spring control valve which must be manually engaged to provide power to the pipe spool drive motor and wire spool drive motor, a wire spool valve for engaging and disengaging only the wire spool drive motor, a pipe spool up control, which governs speed up the pipe spool in a coiling direction, and a pipe spool down control, which governs speed of the pipe spool in an uncoiling direction.

In another preferred embodiment, a pipe clamp comprised of two approximately triangular clamp arms, wherein each clamp arm is connected to a rectangular clamp plate with a clamp pivot bolt, each arm comprises an outer corner with a clamp chain hole and a top corner with a cup-shaped clamp grip, each such cup-shaped clamp grip facing the other clamp grip on opposite sides of a hard pipe, wherein a chain is attached to the clamp chain hole of each arm and, when the chain is pulled upward to exert upward force on the two chain holes, each clamp arm rotates about its respective pivot bolt, thus closing the two clamp grips together and gripping the pipe.

In another preferred embodiment, a method of removing a well pipe and submersible pump from a well using the well pipe pulling and storage device as disclosed herein, including the steps of: 1. loading the well pipe pulling and storage device onto a vehicle; 2. transporting and unloading the well pipe pulling and storage device at a well head, raising the crane into a vertical position and installing and adjusting two jacks to support the pipe pulling and storage device; 3. installing a tee handle on a pitless adapter inside a well casing and connecting a lift clamp to a crane cable of the device and the tee handle; 4. engaging the spring control valve lever and the pipe spool up control to turn the pipe spool and raise the pitless adapter to the well head, temporarily disengaging the spring control valve lever, and removing the lift clamp and tee handle; 5. connecting the pitless adapter to the pitless adaptor connector and thus to the pipe spool and connecting a wire from within the well to the wire spool; 6. reengaging the spring control valve lever and the pipe spool up control to set the pitless adaptor and connector into a pitless adapter pocket within the pipe spool and coil well pipe around the pipe spool and the wire around the wire spool; 7. once a submersible pump attached to the well pipe reaches the well head, disengaging the spring control valve and repairing or replacing the submersible pump; and 8. reengaging the spring control valve lever and engaging the pipe spool down control to uncoil the well pipe and well wire and lower the pump, pipe and wire back into the well.

In another preferred embodiment, the method of removing a well pipe and submersible pump from a well as disclosed herein, wherein the following supplemental step follows step 6: 7. periodically disengaging the spring control valve lever to stop the pipe spool coiling while defects in the well pipe and well wire are identified and repaired.

In another preferred embodiment, the method of removing a well pipe and submersible pump from a well as disclosed herein, wherein the following supplemental step follows step 7: 8. detaching the well wire from the submersible pump and attaching a new well wire from a new wire spool to the submersible pump.

In another preferred embodiment, the method of removing a well pipe and submersible pump from a well as disclosed herein, wherein the following supplemental steps follow step 2: 3. installing a tee handle on a hard well pipe inside a well casing and connecting a lift clamp to a crane cable of the device to the tee handle; 4. clamping a pipe clamp to the crane cable and to the hard well pipe; 5. engaging the spring control valve lever and the pipe spool up control to turn the pipe spool and raise the hard well pipe out of the well until a pipe joint is visible, temporarily disengaging the spring control valve lever, and securing a pipe dog to a pipe section below the pipe joint; 6. unclamping the pipe clamp from a pipe section above the pipe joint and clamping the pipe clamp to the pipe section below the pipe joint; and 7. unsecuring the pipe dog and repeating steps 5 and 6 until all hard well pipe is removed.

DETAILED DESCRIPTION OF THE INVENTION

Figure 1:
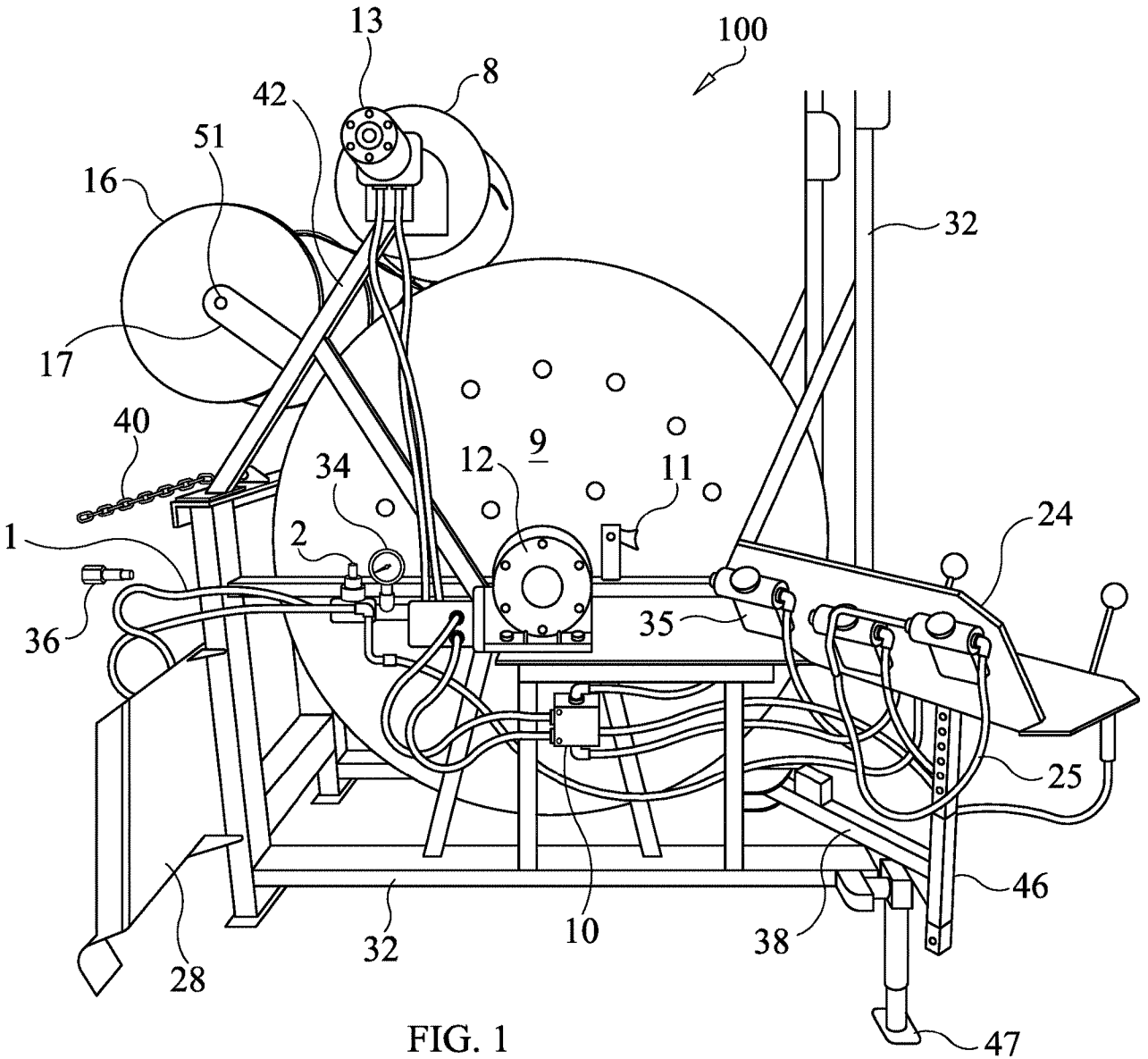
FIG. 1 is a line drawing evidencing a side view of a device for removing a well pipe and storing the pipe on a spool.

The invention is a device and system for removing a well pipe and storing it on a spool, and a related method of removal.

The device is a well pipe puller embodied as a powered, rotating combination of two or three spools, a first spool for collecting flexible well pipe, a second spool for the associated electrical wire, and an optional third spool for new wire, if replacement is required. Each spool is embodied with two circular sides connected by multiple cylindrical members arranged in a circle. The puller device is mobile and can be located directly at a well head. In one embodiment, the puller is transported using a mini skid steer or full-sized skid steer loader, depending on the specifications of the puller itself, which will be manufactured in several series of different sizes depending on the size and length of pipe to be pulled. Alternative methods of transport may also be used, including trucks or, where required, cranes. No assembly or installation of the device at the well site is required except for connection of the two spools to the pipe and wire, respectively, and stabilization as required using support jacks.

In combination with a powering mechanism and a means of attachment to a well pipe, the device further constitutes a well pipe removal system. The device is powered hydraulically, such as by a power-take-off supplied by a vehicle, which allows a user to control both the speed and direction of spool turning. As such, no electrical cords, generator, blocking machine or other power plant or equipment is required beyond the vehicle on which the puller device is transported. As used for well pipe pulling, the speeds and directions of all engaged spools (e.g., pipe spool and wire spool(s)) should match when the device is engaged, allowing for simultaneous spooling or unspooling of pipe and wire. In a preferred embodiment, spooling speed is variable at between approximately 1 to 7 rpm, with and average of 5 rpm. This embodiment also features the retrieval or reinsertion of approximately 9 feet of pipe/wire per revolution, allowing for an average of approximately 45 feet of pipe/wire per minute to be spooled or unspooled.

Hydraulic power components controlling the speed and direction of spooling include hydraulic piping, a drive motor for the pipe spool, drive motor for the wire spool, hydraulic drive gear reduction motor, brakes for each of the pipe and wire spools, pressure gauge, spring control valve, wire spool valve, flow control balance valve and adjustable relief valve. The spring control valve controls the entire power system and closing the spring valve thus effects a total power shutdown. The wire spool valve is preferably embodied as a detent valve, which releasably retains itself in an open position and hydraulically returns to a neutral position in response to a predetermined pressure in the hydraulic system via a relief valve.

In an alternate embodiment, the powering mechanism of the described pipe removal system could be based on alternating current flowing from a power grid or generator and comprise electric motors, cords and related components.

The well pipe puller includes a control table that is connected to corresponding hydraulic couplings of a vehicle, which control table controls the rotational movement of the device's pipe and wire spools, using pressurized hydraulic fluid via a network of interconnected conduit. In one embodiment, the control table has two directional or control valves, pipe spool up control and pipe spool down control, for controlling the speed of rotation of the pipe spool for selectively retrieving or paying out pipe. The device also comprises a single wire spool valve, which engages the wire spool in the up/retrieving direction only, and a wire spool speed control. The control table will allow for settings wherein each of the pipe and wire spools are operated simultaneously, in the same direction and at the same rate of retrieval using the flow control valves. A single spring control valve alone operates both functions.

Movement of the spring control valve into a first position such as an upper position causes the rotational movement of pipe spool to lift the pipe out of the well. In response to the spring control valve being moved into a second position, such as a lower position, the pipe is returned to the well. When the spring control valve lever is positioned between the upper and lower positions, i.e., a neutral position, there is no hydraulic power that is applied to the system, resulting in the hydraulic brake being applied and the spools being locked in position.

A hydraulic brake, preferably embodied as a pawl, prevents rotation of pipe spool when it is desired to halt operation, such as for repair or other reasons in one embodiment, one valve, such as spring control valve, is spring loaded and controls both flow control and flow direction of control table. That is, in this embodiment, both pipe and wire spools can be stopped at the same time, such as by an operator releasing the lever of spring control valve allowing springs to move spring control lever into a neutral position that automatically shuts off hydraulic power to such spools, thus requiring only one hand to operate the puller. In one embodiment, the rotation of pipe spool is controllable so that tension is maintained during operation. As the spring control lever returns to neutral, the hydraulic brake is automatically engaged, preventing unwanted coiling or payout of pipe.

Once the skid steer or other vehicle transporting the pipe pulling device and system approaches a well head, set up begins with installation of a tee handle wrench on a pitless adapter inside the well casing, usually three to four feet below the surface. A crane component of the puller device, which is folded down during transport, is raised and stabilized onto the frame mount with two or more crane pins. Two adjustable jacks are installed on the lower front of the frame mount to stabilize the machine, and a hard pipe clamp connects the tee handle to the crane cable. Upon engagement of the spring control valve into a first position for coiling movement, the cable, which is driven by the pipe spool and extends over the crane pulley, to begin raising the pipe and connected pump. Typically, the well's pitless adapter is pulled to the top of the well to access the pipe to determine the type of material used. If it is hard pipe, such as galvanized or PVC stick pipe, it will be raised in 10 foot intervals and removed in 20-21 foot sections. Each interval is held with a "pipe dog" embodied as a clamp to hold pipe in place on the well head while the clamp is disengaged from the removed pipe and reattached to the pipe still to be pulled.

Once the well's pitless adapter reaches the surface, and it is determined that there is coil (flexible) pipe in the well, the pipe is held with the pipe dog. The clamp and crane cable are then removed and a threaded adapter is installed into the pitless adapter by screwing the respective threaded components, which attaches the to the coiling well pipe below. The crane cable is then removed from the crane pully and put to the side. The pitless adapter is then connected to the spool cable. The spring control valve is then engaged, rotating the pipe spool in the coiling direction, which motion sets the pitless adapter into the pocket and begins coiling the flexible pipe around the spool.

Once the pitless is set, the spring control valve is temporarily disengaged, the electrical wire from inside the well is pulled up and attached to the wire spool, usually by simply tying the wire to a cross-member in the spool, and the wire spool valve is engaged to activate the wire spool drive motor. Upon disengagement and return of the spring control valve to the neutral position, the hydraulic brake automatically engages through its pawl mechanism. In the event of failure, a second, manual, brake is also available. When the spring control valve is reengaged, it then engages both drive motors and allows both the wire and pipe spools to begin coiling at the same rate with speed adjustment to each spool through the flow dividers.

Speed controls embodied as flow valves for each spool can be independently controlled by levers on the control table. Releasing the spring control valve lever automatically returns the lever to neutral and immediately closes the valve, stops oil flow to all functions and ceases all movement. Each of the pipe and wire is visually inspected as it is pulled and separated before they are independently coiled about their respective spools. If a defect is noted, the spring control valve is shut and a repair is made before coiling begins again. Once the pipe and wire is fully removed and the pump reaches the well head, the pump is inspected and repaired or replaced before the entire process is reversed.

The control table includes separate directional control levers and valves for the pipe spool. With the spring control valve lever being engaged in the down/uncoiling position, the pump, with wire attached, is lowered into the well. The pump descends into the well and the wire follows simultaneously, coming off of the wire spool. The wire spool control valve is set to neutral and allows the wire to be pulled down with the pump naturally upon reinstallation, and thus no powered down/uncoiling setting is required for the wire spool. In the event that the pulled wire is too damaged for reuse, an unmotorized new wire spool loaded with new wire is also located on the wire puller frame, with such wire being attached to the pump prior to reinstallation and paid out manually thereafter. In either event, the wire is taped to the pipe during lowering.

Detailed Description of the Figures

FIG. 1 shows a well pipe puller 100 while not in use, comprising pipe spool 9 and wire spool 8, as well as an optional new wire spool 16. Pipe spool 9 surrounds pipe spool draft shaft 14 (not visible), which is attached to pipe spool drive motor 12, embodied as a hydraulic gear reduction motor. Wire spool 8 surrounds wire spool draft shaft 15 (not visible), which is attached to wire spool drive motor 13. Also visible is manual brake 11 on the outer face of the pipe spool. The well pipe puller as pictured is self-contained. For purposes herein, "self-contained" means that the puller includes both the capability of propelling itself, by mounting on a skid steer or similar vehicle 51 between locations and the capability to operate as intended (e.g., pull pipe and electrical cable, access/replace pump, re-install pipe, electrical cable and pump) without requiring further assembly or an external power source, meaning that the puller can operate as intended in remote areas.

Preferably, the pipe spool 9 comprises a 30-38" wide inner diameter, with a preferred width of 34", and 42-54" wide outer sides, with a preferred width of 48". A preferred breadth of the pipe spool is 12-24", with a more preferred breadth of 16". The wire spool 8 preferably comprises a 4-10" wide inner diameter, with a preferred width of 6", and 8-16" wide sides, with a preferred width of 12". Further, the pipe spool drive shaft is preferably approximately 1.5" in diameter and the wire spool drive shaft is preferably 1" in diameter. A preferred breadth of the wire spool is 12-24", with a more preferred breadth of 15". New wire spool 16 is preferably sized similarly to wire spool 8.

Supply hoses 1 delivering oil to and from the hydraulic power drive system are shown entering the system at the flow control balance valve 2, which is also attached to pressure gauge 34. The flow control balance valve allows for connection to machines with greater oil flow or pressure than needed. This valve regulates the pressure and flow of oil to operate the machine. The flow control balance valve relieves excess pressure and dumps oil flow back into the return line. Thereafter, flexible hydraulic piping 25 continues the oil flow from the pressure gauge to a pipe spool hydraulic brake 10, as well as the two spool drive shaft motors. Such hydraulic piping further attaches control table 24 and the lever controls thereon to the valves, motors and brakes of the larger system, thus allowing an operator to engage or disengage the motors and brakes, as well as to adjust the speed and direction of spool turning. The control table is shown connected to frame mount 32 by adjustable arm 38.

A rigid framework is employed to mount and contain the various moving parts of the pictured pipe pulling device 100. The framework itself is preferably comprised of hollow, square metal members that can be overlaid and attached by bolting, screwing, snap-fitting or similar means. Such framework comprises a transportation plate 28, which is adaptable and provides for connecting the device to a skid steer or mini skid steer. The pipe spool 9 is mounted on frame mount 32 with 44, which acts as a mounting system allowing the pipe spool to spin freely around its drive shaft. Attached to frame mount 32 is wire support frame 42, which extends to mount the wire spool 8 and allow it to spin above the pipe spool. Also visible is wire spool holder 17, attached to wire support frame 42, upon which new wire spool 16 is mounted. The new wire spool is employed only when new electrical wire is required to be installed in a serviced well. It is unpowered as it is used only in a pay-out direction as wire is fed into the well.

Figure 2:
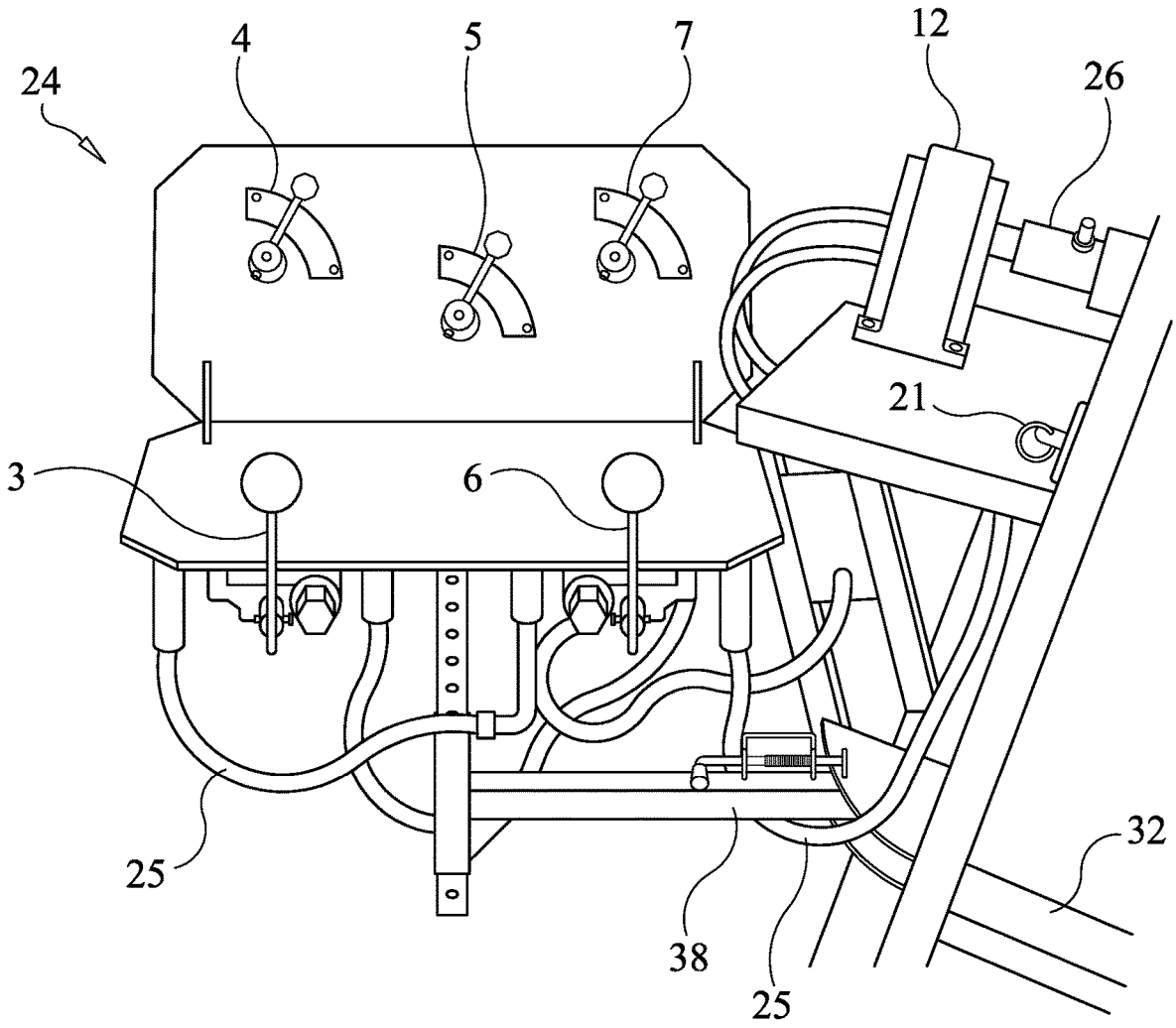
FIG. 2 is a line drawing evidencing a control table for the device of FIG. 1.

FIG. 2 shows the hydraulic control table 24 evidencing multiple levers controlling the spring control valve 3, wire spool valve 6, pipe spool up control 4 and down control 5 and the wire spool speed control 7, as well as multiple supply hoses 1. Such hoses are shown connecting the control table to the hydraulic pipe spool drive motor 12, embodied as a hydraulic driven gear reduction, through a drive coupling for the pipe spool 26 to the pipe spool drive shaft 14 (not pictured). A pin for crane connection 21, connecting the crane to the frame mount is also shown.

Figure 3:
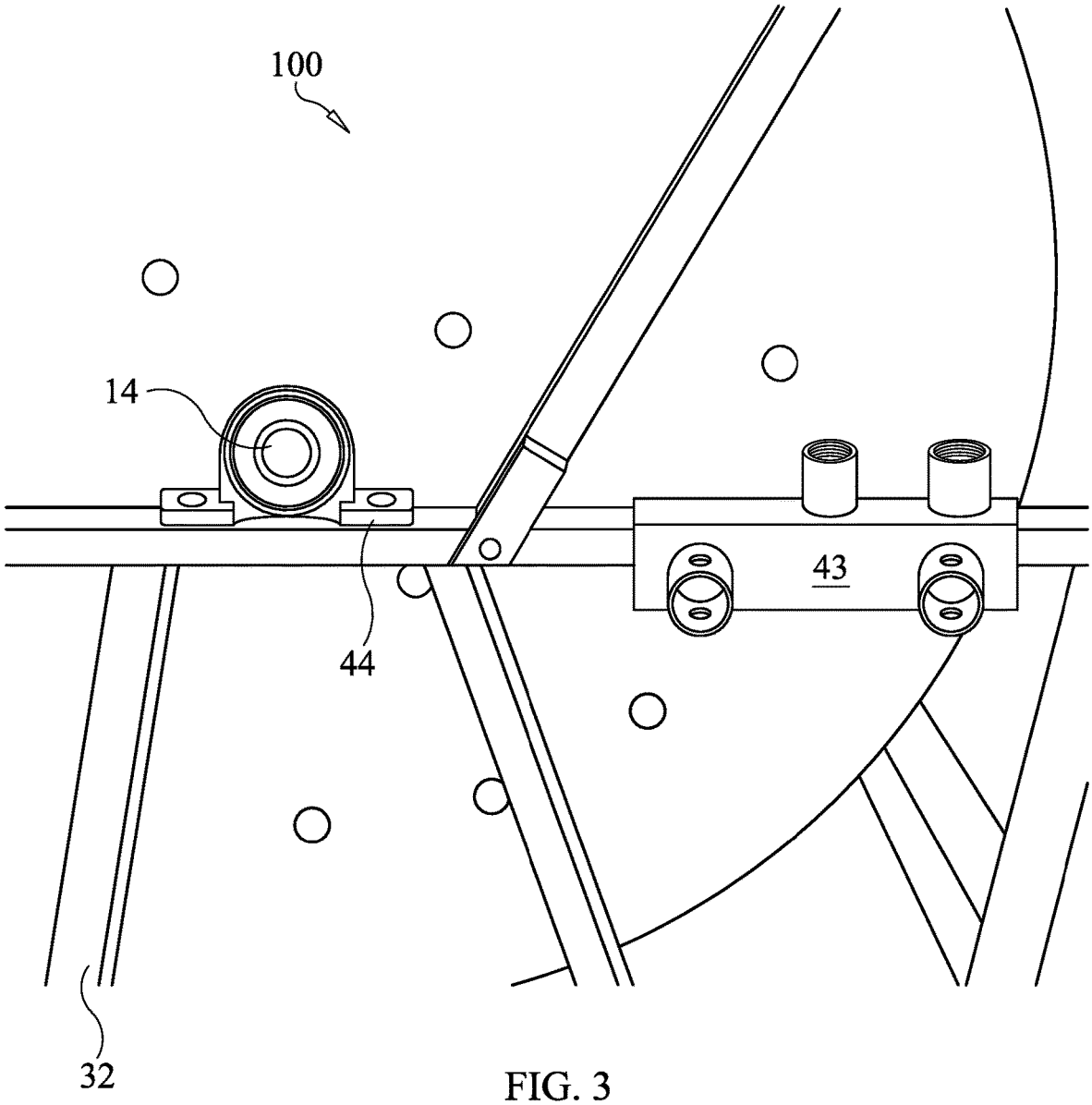
FIG. 3 is a line drawing evidencing a close-up view of the pipe spool and frame mount of the device of FIG. 1.

FIG. 3 shows a close-up view of the side of the pipe spool 9, overlaid by the jack and adapter connection 43. Pipe spool pill block bearings 44 are shown bolted to the frame mount 32, with such block bearings circumnavigating the protruding end of pipe spool drive shaft 14.

Figure 4:
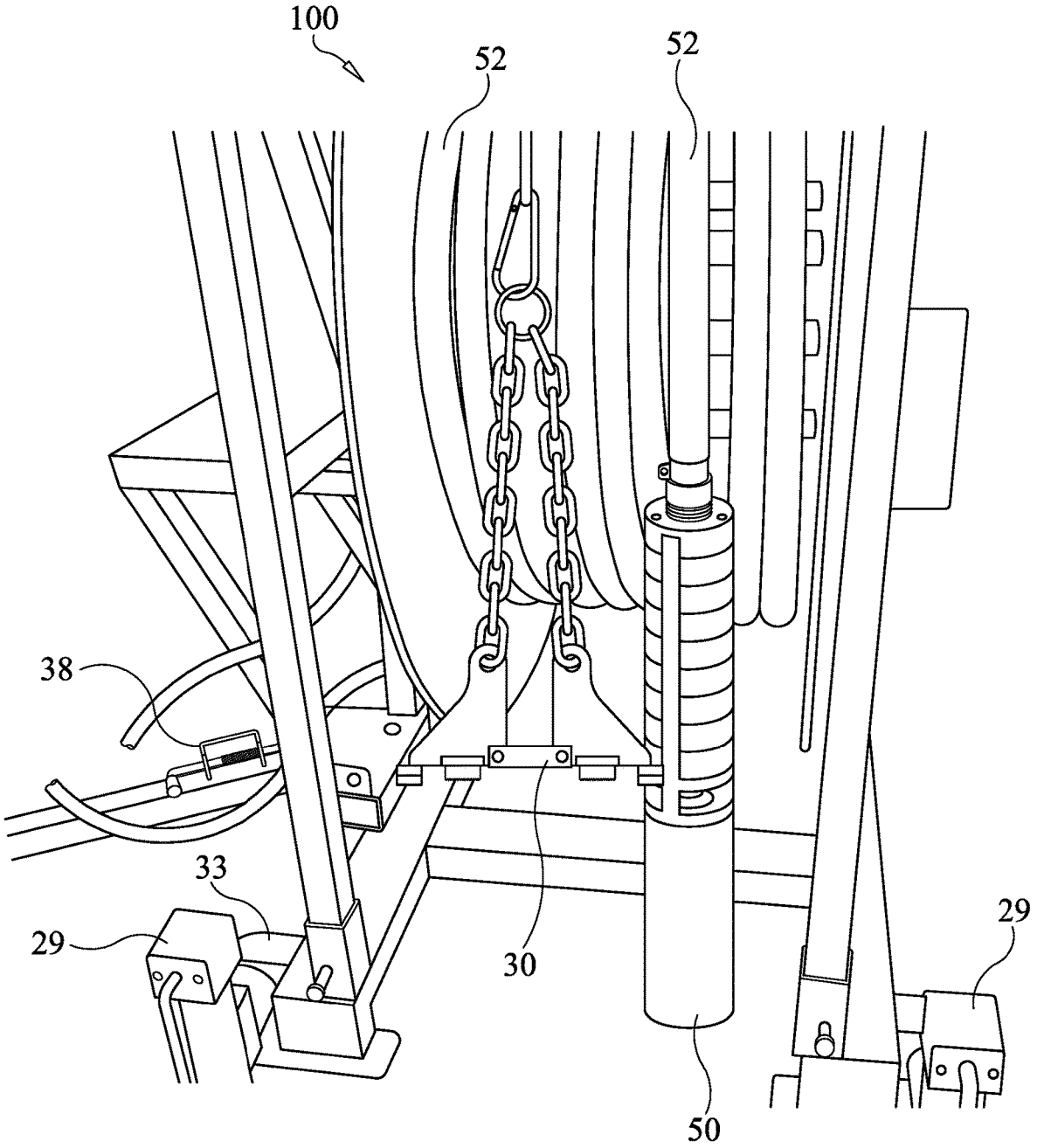
FIG. 4 is a line drawing evidencing an end view of the pipe spool of the device of FIG. 1.

FIG. 4 shows an end view of the well pipe puller 100, with pulled well pipe 52 shown coiled on the pipe spool 9, with support jacks 29 and a hard pipe clamp 30 visible.

Figure 5:
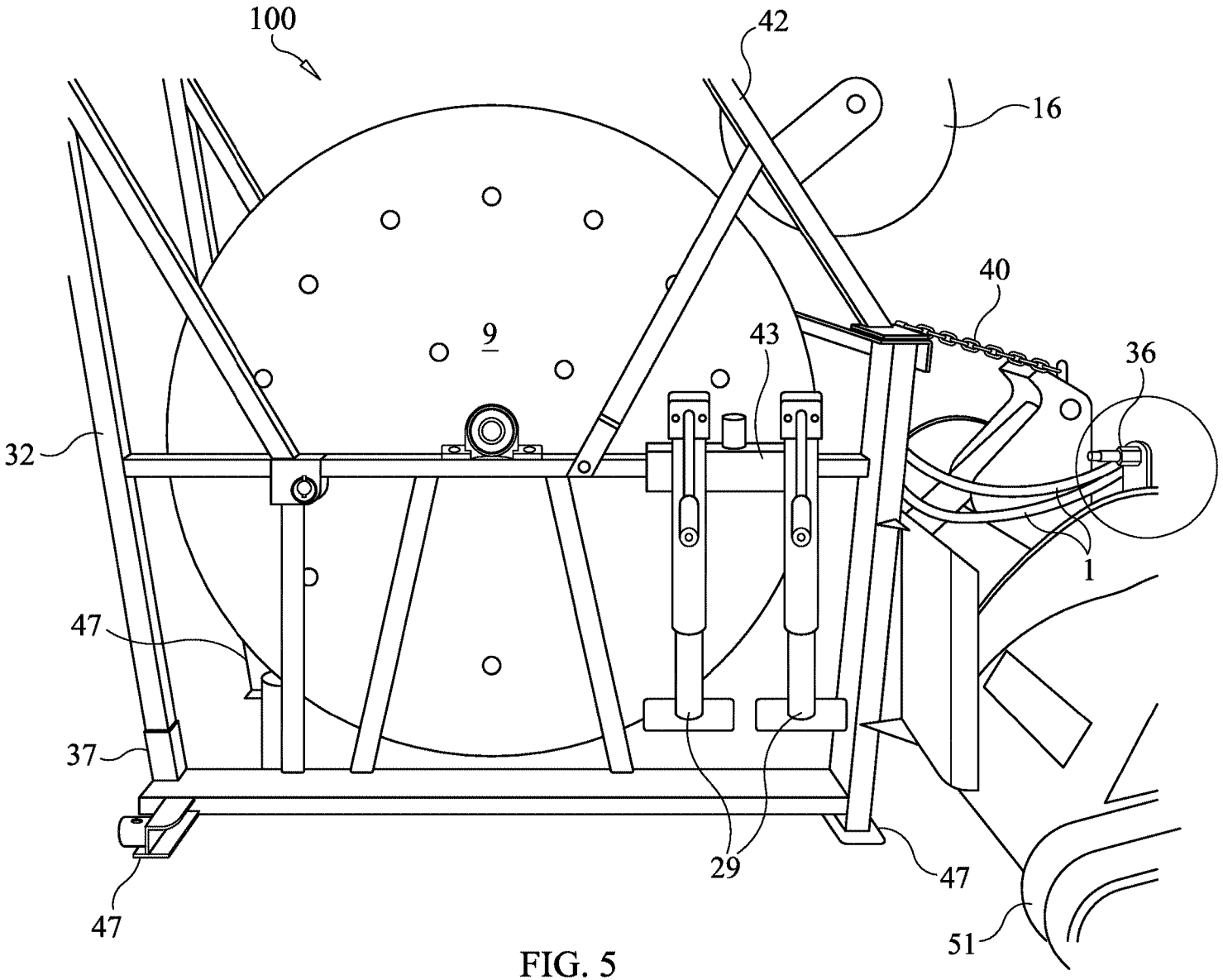
FIG. 5 is a line drawing evidencing the device of FIG. 1 loaded on a skid steer for transport.

FIG. 5 is an alternate side view of the well pipe puller 100 while mounted on a skid steer with chain linkage support 40. Support jacks 29 are undeployed and hanging on the jack and adapter connection storage 43. The mount is fitted into support legs 47 via frame pockets 37. Quick connect couplings 36 are visible on the vehicle 51, such couples connected to supply hose 1.

Figure 6:
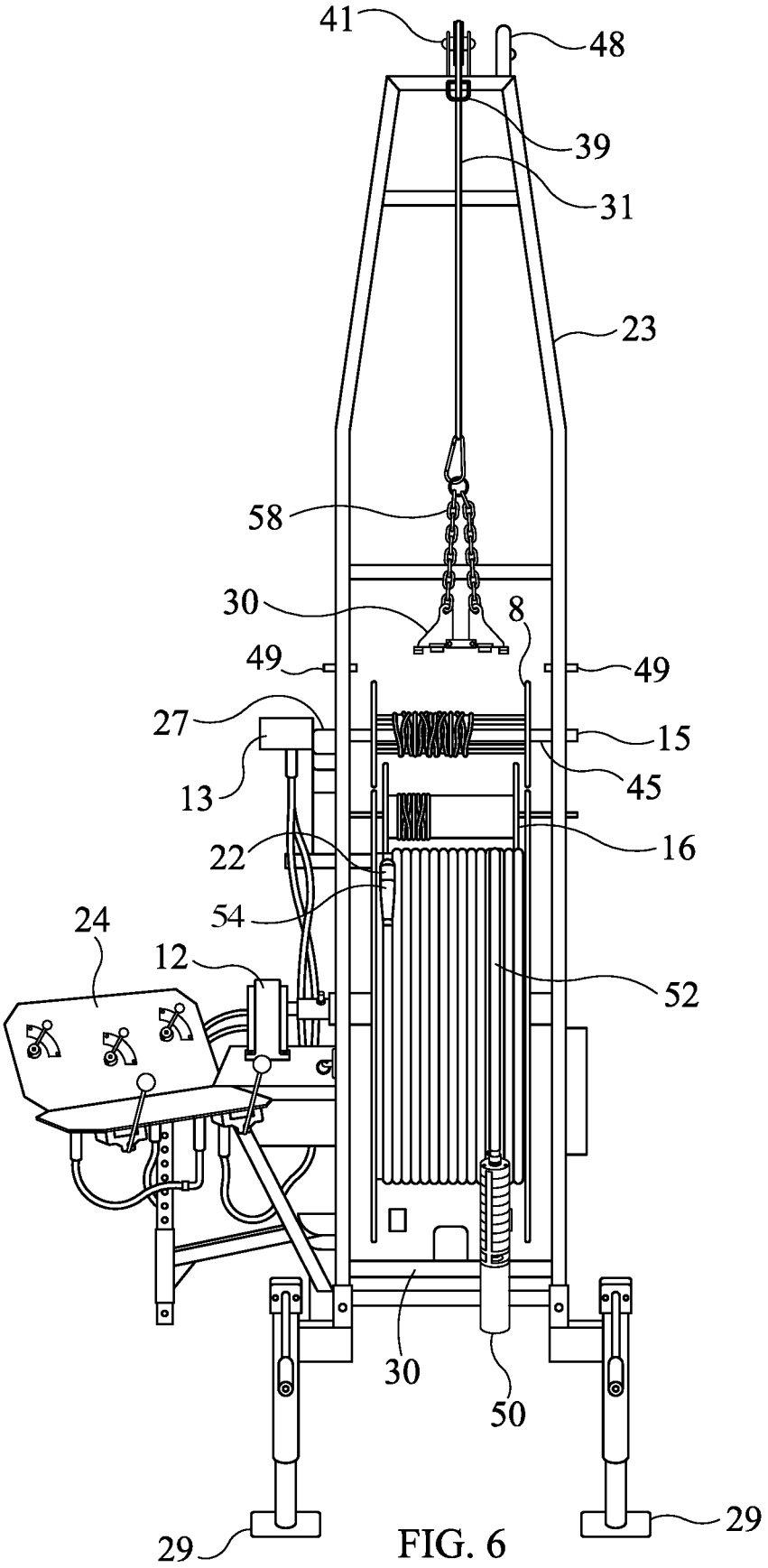
FIG. 6 is a line drawing evidencing a full end view of the device of FIG. 1.

FIG. 6 shows an end view of the well pipe puller 100, with the foldable crane 23 extended upward from the frame mount 32 for use in hard or stick well pipe (not pictured) removal, with cable 31 descending from cable pulley 41 and cable guide 39, terminating into chain 58 and hard pipe clamp 30. The frame mount 32 is mounted atop the two adjustable support jacks 29. Crane pivot 49, embodied as a joint, appears on the sides of the crane. Well pipe 52 is shown coiled about pipe spool 9, while submersible pump 50 is hanging therefrom. Wire spool 8 is located above the pipe spool, with wire spool pill block bearings 45 and pipe spool pill block 44 bearings showing on the sides, respectively. Pitless adapter 54 and the pitless connector 22, connected via their respective screw threads, are shown seated within the pitless adapter pocket 18 (not visible) on the pipe spool.

Figure 7:
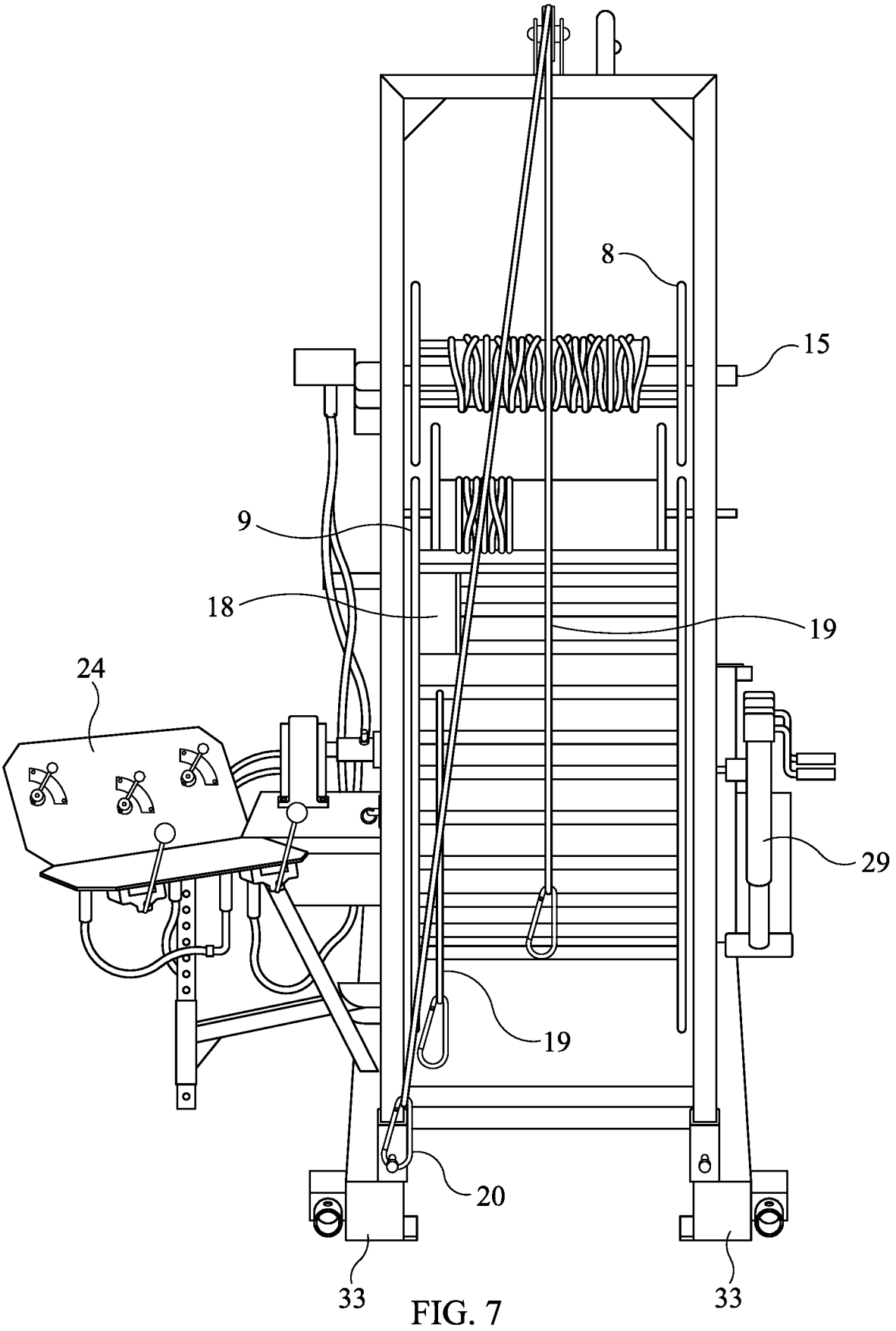
FIG. 7 is a line drawing evidencing an alternate end view of the device of FIG. 1.

FIG. 7 shows another end view of well pipe puller 100, this time with no pipe coiled about pipe spool 9, exposing pitless adapter pocket 18, into which a pitless adapter/pitless connection 22 (not pictured) are set as pipe coiling begins. Pull cable 19 is attached to the pipe spool adjacent to and aligned with the pitless adapter pocket, and will ideally be equal in length to the circumference of the spool, so that the pitless adapter will naturally settle into the pocket upon connection to the pull cable and a full revolution of the spool. Wire spool 8 is located above the pipe spool, and wire pool drive shaft 15 is pictured.

Figure 8:
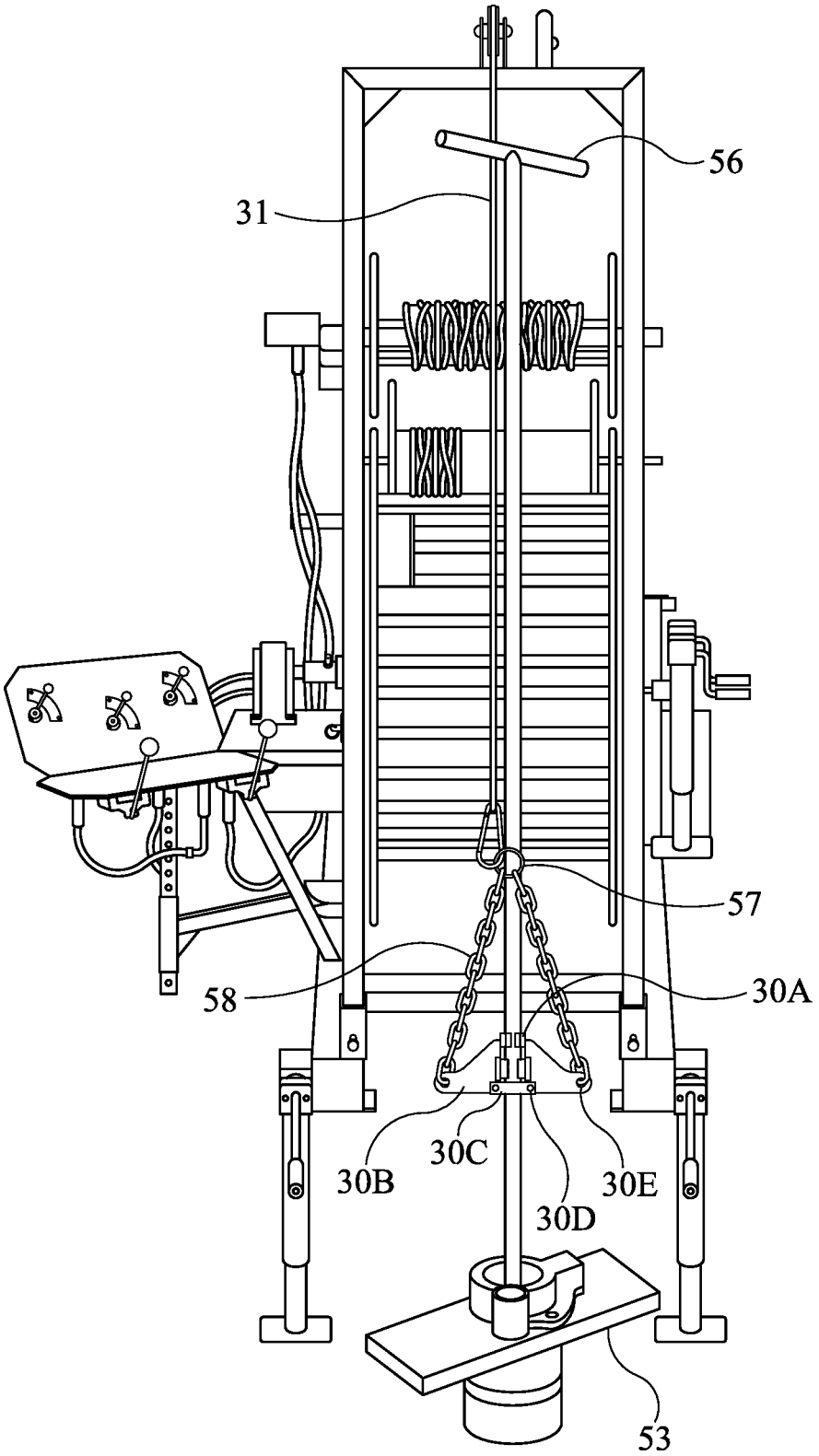
FIG. 8 is a line drawing evidencing an end view of the device of FIG. 1 actively pulling well pipe.

FIG. 8 shows an end view of the well pipe puller 100 engaged in pulling a section of hard well pipe 52, which pipe is partially extracted from the well. Tee handle 56 is shown attached to the top of the pipe section, crane 23 is shown in its upright position with crane cable 31 extending downward to hard pipe clamp 30. As pictured, the pipe section is held in place by the pipe dog 53 sitting atop the well head, with clamp 30 set about the pipe and ready to engage upon the upward pull of the cable on the clamp ring 57 and thereby to the clamp chain 58.

Upward force applied to the crane cable and thus to the clamp closes the clamp and captures the pipe for pulling upward. In particular, the clamp 30 is comprised of two clamp arms 30B, each arm connected by a clamp plate 30C with a clamp pivot bolt 30D. Each clamp arm 30B roughly triangularly shaped, with a clamp chain hole 30E at the outer point and a cupped clamp grip 30A at the top point, such that the two clamp grips face one another on opposite sides of a hard well pipe 52. The clamp chain 58 is attached to the hole 30E of each arm such that, when the crane cable 31 pulls upward on the clamp ring 57, each chain 58 exerts upward force on its corresponding chain hole 30E, rotating the arm upward about its respective pivot bolt 30D and closing the two clamp grips together over the pipe 52, allowing the pipe to be pulled. Once the pipe is pulled upward far enough for a section to be removed, the pipe dog 53 is engaged to hold the next pipe section, while the pulled section is removed and set aside, and the clamp 30 is reset on the next section.

Figure 9:
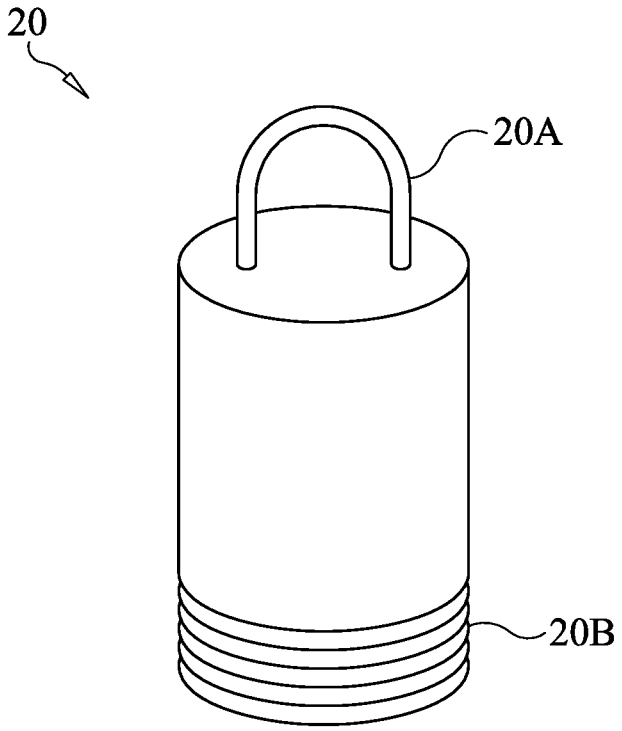
FIG. 9 is a line drawing evidencing a connection to pitless and/or pipe holder used to connect the device of FIG. 1 to a pitless adapter.

FIG. 9 shows an embodiment of the connection to pitless and/or pipe holder 20, embodied as a cylinder or pipe comprising a handle 20A on one end for connection to a cable via a carabiner, clip or similar mechanism (not pictured), and screw threads 20B for a screw-in connection with a pitless adapter.

In the present disclosure, other than where otherwise indicated, all numbers expressing quantities or characteristics are to be understood as being prefaced and modified in all instances by the term "about." Accordingly, unless indicated to the contrary, any numerical parameters set forth in the following description may vary depending on the desired properties one seeks to obtain in the embodiments according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

It is to be understood that the various descriptions of the embodiments disclosed herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

LIST OF REFERENCE NUMBERS

1. Supply hoses
2. Flow control balance valve
3. Spring control valve
4. Pipe spool up control—speed flow control
5. Pipe spool down control—speed flow control
6. Wire spool detent valve
7. Wire spool speed control
8. Wire spool
9. Pipe spool
10. Pipe spool hydraulic brake
11. Drum manual brake
12. Pipe spool drive motor
13. Wire spool drive motor
14. Pipe spool drive shaft
15. Wire spool drive shaft
16. New wire spool
17. Wire spool holder
18. Pitless adapter pocket
19. Pull cable
20. Connection to pitless and/or pipe holder
20A. Handle
20B. Screw threads
21. Crane pin
22. Pitless connection
23. Crane
24. Control table
25. Hydraulic piping
26. Drive coupling for pipe drum
27. Drive coupling of wire spool
28. Transportation plate
29. Support Jacks
30. Hard pipe clamp 30A. Clamp grip
30B. Clamp arm
30C. Clamp plate
30D. Clamp pivot bolt
31. Cable for hard pipe pulling
32. Frame mount
33. Jack mount connection
34. Pressure gauge
35. Adjustable relief valve
36. Quick connect couplings
37. Frame connecting pockets
38. Adjustable arm to control panel
39. Cable guide
40. Chain linkage support
41. Cable pulley
42. Wire support frame
43. Jack and adapter connection storage
44. Pipe spool pill block bearings
45. Wire spool pill block bearings
46. Adjustable table slide
47. Support legs
48. Halo holder
49. Crane pivot
50. Submersible pump
51. Vehicle
52. Well pipe
53. Pipe dog
54. Pitless adapter
56. Tee handle

57. Clamp ring
58. Clamp chain
100. Well pipe puller

The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. A well pipe pulling and storage device, comprising a pipe spool, at least one wire spool, a power supply, a pipe spool drive motor, a wire spool drive motor, a brake for the pipe spool, a control table comprising controls for the speed and direction of each pipe and wire spool, a foldable crane, a frame mount comprising a transportation plate for loading onto a vehicle, such vehicle also comprising a power-take-off for providing power to the well pipe pulling and storage device and a spring control valve which must be manually engaged to provide power to the pipe spool drive motor and wire spool drive motor and a wire spool detent valve for engaging and disengaging only the wire spool drive motor.

2. The well pipe pulling and storage device of claim 1, wherein the power supply is hydraulic and the controls are one or more valves.

3. The well pipe pulling and storage device of claim 1, wherein the pipe spool drive motor is powered in both a coiling direction and a payout direction while the wire spool drive motor is powered only in a coiling direction.

4. The well pipe pulling and storage device of claim 1, further comprising a pipe spool up control, which governs speed up the pipe spool in a coiling direction, and a pipe spool down control, which governs speed of the pipe spool in an uncoiling direction.

5. The well pipe pulling and storage device of claim 1, wherein the vehicle is a skid steer or mini skid steer.

6. A well pipe pulling and storage system, comprising a pipe spool, at least one wire spool, a pipe spool motor, a wire spool motor, a control table comprising controls for the speed and direction of each pipe and wire spool, a foldable crane, a frame mount comprising a transportation plate for loading onto a vehicle, such vehicle comprising a power-take-off for providing hydraulic power to the well pipe pulling and storage device, wherein the hydraulic power system comprises hydraulic piping, a pipe spool drive motor, a wire spool drive motor, a hydraulic brake for each of the pipe spool and wire spool, a pressure gauge, a spring control valve, a wire spool detent valve, flow control balance valve and adjustable relief valve.

7. The well pipe pulling and storage system of claim 6, wherein the pipe spool drive motor is a hydraulic gear reduction motor and the wire spool drive motor is a hydraulic motor.

8. The well pipe pulling and storage system of claim 6, further comprising a spring control valve which must be manually engaged to provide power to the pipe spool drive motor and wire spool drive motor, a wire spool valve for engaging and disengaging only the wire spool drive motor, a pipe spool up control, which governs speed up the pipe spool in a coiling direction, and a pipe spool down control, which governs speed of the pipe spool in an uncoiling direction.

9. A method of removing a well pipe and submersible pump from a well using the well pipe pulling and storage device of claim 1, including the steps of:

1. loading the well pipe pulling and storage device onto a vehicle;
2. transporting and unloading the well pipe pulling and storage device at a well head, raising the crane into a vertical position and installing and adjusting two jacks to support the pipe pulling and storage device;
3. installing a tee handle on a pitless adapter inside a well casing and connecting a lift clamp to a crane cable of the device and the tee handle;
4. engaging a spring control valve lever and a pipe spool up control to turn the pipe spool and raise the pitless adapter to the well head, temporarily disengaging the spring control valve lever, and removing the lift clamp and tee handle;
5. connecting the pitless adapter to a pitless adaptor connector and thus to the pipe spool and connecting a wire from within the well to the wire spool;
6. reengaging the spring control valve lever and the pipe spool up control to set the pitless adaptor and connector into a pitless adapter pocket within the pipe spool and coil well pipe around the pipe spool and the wire around the wire spool;
7. once a submersible pump attached to the well pipe reaches the well head, disengaging the spring control valve and repairing or replacing the submersible pump; and
8. reengaging the spring control valve lever and engaging a pipe spool down control to uncoil the well pipe and well wire and lower the pump, pipe and wire back into the well.

10. The method of removing a well pipe and submersible pump from a well of claim 9, wherein the following supplemental step follows step 6:

7. periodically disengaging the spring control valve lever to stop the pipe spool coiling while defects in the well pipe and well wire are identified and repaired.

11. The method of removing a well pipe and submersible pump from a well of claim 9, wherein the following supplemental step follows step 7:

8. detaching the well wire from the submersible pump and attaching a new well wire from a new wire spool to the submersible pump.

12. The method of removing well pipe and submersible pump from a well of claim 9, wherein the following supplemental steps follow step 2, 3. installing a tee handle into the pitless adapter and pulling hard or stick pipe to the surface in 20- or 21-foot lengths, wherein the lift clamp is attached to the cable from the crane by rotating a drum either up or down;
4. clamping a pipe clamp to the crane cable and to the hard well pipe;
5. engaging the spring control valve lever and the pipe spool up control to turn the pipe spool and raise the hard well pipe out of the well until a pipe joint is visible, temporarily disengaging the spring control valve lever, and securing a pipe dog to a pipe section below the pipe joint;
6. unclamping the pipe clamp from a pipe section above the pipe joint and clamping the pipe clamp to the pipe section below the pipe joint;

7. unsecuring the pipe dog and repeating steps 5 and 6 until all hard well pipe is removed.

* * * * *